US005626550A

United States Patent [19]

Amero et al.

[11] Patent Number: 5,626,550

[45] Date of Patent: May 6, 1997

[54] EASY DISPENSE T-SHIRT BAGS

[75] Inventors: John S. Amero, Villa Park; Carmelo Piraneo; Gary A. Woodruff, both of Torrance; John E. Alvey, Fullerton, all of Calif.

[73] Assignee: Orange Plastics, Inc., Compton, Calif.

[21] Appl. No.: 130,310

[22] Filed: Oct. 1, 1993

[51] Int. Cl.[6] ..... B31B 27/60; B31B 23/86

[52] U.S. Cl. ..... 493/204; 493/194; 493/212; 493/926

[58] Field of Search ..... 493/193–197, 493/210, 212, 267, 204

[56] References Cited

U.S. PATENT DOCUMENTS

| | | | |
|---|---|---|---|
| Re. 33,264 | 7/1990 | Baxley et al. | 206/554 |
| 4,165,832 | 8/1979 | Kuklies et al. | 229/54 R |
| 4,529,087 | 7/1985 | Neal et al. | 206/328 |
| 4,560,067 | 12/1985 | Reimann | 206/554 |
| 4,676,378 | 6/1987 | Baxley et al. | 206/554 |
| 4,744,200 | 5/1988 | Benoit, Jr. et al. | 53/447 |
| 4,785,938 | 11/1988 | Benoit, Jr. et al. | 206/554 |
| 4,796,759 | 1/1989 | Schisler | 206/554 |
| 4,811,417 | 3/1989 | Prince et al. | 383/9 |
| 4,854,999 | 8/1989 | Schirmer | 156/272 |
| 4,877,473 | 10/1989 | Snowdon et al. | 156/204 |
| 4,989,732 | 2/1991 | Smith | 206/554 |
| 5,020,750 | 6/1991 | Vrooman et al. | 248/97 |
| 5,062,927 | 11/1991 | Stout | 203/89 |
| 5,087,234 | 2/1992 | Prader et al. | 493/194 |
| 5,183,158 | 2/1993 | Boyd et al. | 206/554 |
| 5,307,935 | 5/1994 | Kemanjian | 206/554 |

OTHER PUBLICATIONS

A pack of bags manufactured by Mobil Corporation, New York, New York.

A pack of bags manufactured by Sonoco Products Company, Hartsville, South Carolina.

A pack of bags manufactured by Cupples.

A pack of bags manufactured by Plasco Press Co., Inc., Azusa, California.

*Primary Examiner*—J. Elpel

*Assistant Examiner*—Christopher W. Day

*Attorney, Agent, or Firm*—Jeffrey G. Sheldon; Sheldon & Mak, Inc.

[57] ABSTRACT

A bag pack comprises a plurality of easy open handle bags. The bags are easy to open because the exterior surfaces of the bags are cold-welded together so that when one bag is pulled from the pack, the adjacent next bag is at least partly open. The external surfaces of the bags are not welded to the internal surfaces of the bags during the pressure welding process, because the material that forms the external surface of the bag is treated with a corona discharge, which renders the external surface more susceptible to cold weldings. Optionally a static charge is induced on the bags so that each bag is at a different voltage than the adjacent bags so the bags attract each other, and the panels of each individual bag repel each other, to contribute to the easy open feature.

25 Claims, 3 Drawing Sheets

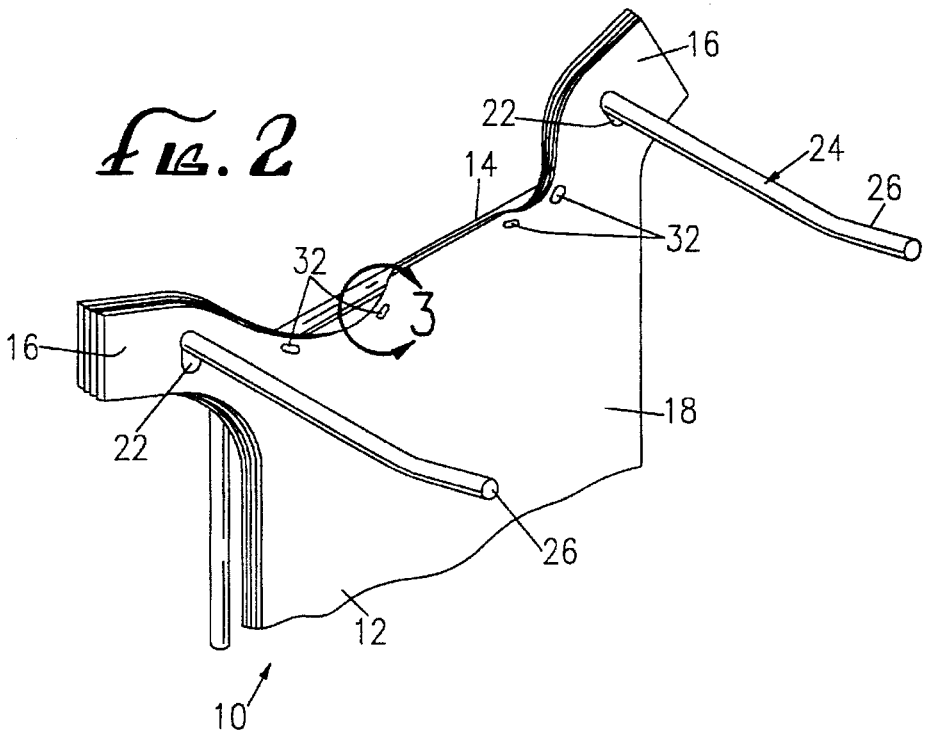
FIG. 2
FIG. 5
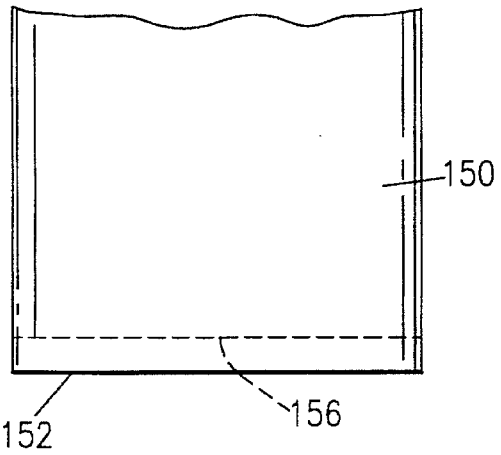
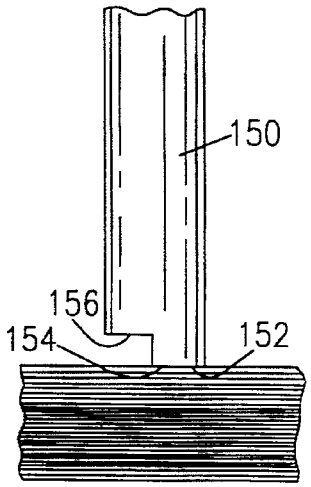
FIG. 4
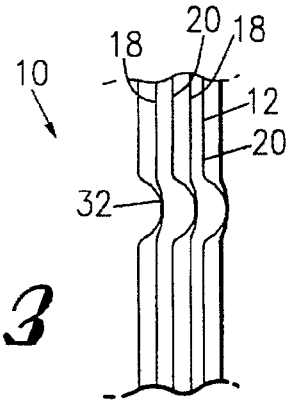
FIG. 3

EASY DISPENSE T-SHIRT BAGS

BACKGROUND

The present invention relates to packs of bags, and particularly stackable bags useful in a system for dispensing stackable bags.

As everyone has seen when he or she passes through a grocery or discount store check-out line, there is a grocery bagger who loads the groceries into a bag, which is usually made from paper or plastic. For convenience of the customer and efficiency of the business, this bagging operation is performed as quickly as possible with very little wasted motion.

Many different methods have been devised to simplify and expedite the procedure of filling the bag with goods or groceries. Currently, the grocery bags found in many stores arrive at the store in neatly stacked bundles called bag packs. The bag pack is composed of individual bags uniformly stacked into a single pack and held together with small pin welds.

As found in most stores, to complement the bag pack, a metal wire rack having two laterally spaced apart outwardly extending support arms is used to suspend the bag pack. At the end of a check-out line, the grocery bagger stands over the rack-mounted bag pack, and dispenses and fills the bags, one at a time. Each stackable bag in the bag pack optionally has pleated sides or bottom, with an open top and upwardly extending handles. This type of bag is conventionally described as a t-shirt bag because its appearance is reminiscent of its namesake. Toward the center of the bag opening, between the handles, there is usually a tab with a horizontal aperture by which the bag is suspended from a center retaining hook located on the rack. After the bag is loaded, the grocery bagger slides the bag handles off of the outward projecting arms which previously suspended them, and detaches the bag from the tab to release the bag from the rack. The individual pin welds are easily separated with only slight tugging. Such a bag pack dispensing system is disclosed in U.S. Pat. No. Re. 33,264 to Baxley et al., and U.S. patent application Ser. No. 875,349, filed Apr. 29, 1992, by Carmelo Piraneo, Salim Bana, Jonathan Karp, and Walter Eugene Tinsley, which application is incorporated herein by this reference.

It is becoming very important that these stackable bags be easy to open. This is because many stores are going to self-service, where inexperienced consumers are expected to bag their own merchandise. Any difficulty in opening bags, and separating one bag from another in the bag pack, leads to costumer frustration and dissatisfaction, as well as slowing down check-out lines.

In an attempt to render these bags easy to open, as described in the aforementioned Baxley et al. U.S. Pat. No. Re. 33,264, a readily disengageable adhesive can be used for adhesively bonding the rear panel of one bag to the forward panel of a following bag. This results in the following bag opening as the top bag in the stack is moved off the metal wire rack. However, a difficulty with this approach is that adhesive needs to be placed on each bag individually, which can increase the cost of fabricating the bag pack, which cost needs to be passed on the consumer.

Accordingly, there is a need for inexpensively and efficiently forming easy open bags, where removal of a bag from the wire rack results in opening of the following bag.

SUMMARY

The present invention provides a method that meets the need for inexpensively forming a bag pack comprising a plurality of easy open bags. The method starts with an elongated, flattened tube, the tube having an external surface and an internal surface. At least a portion of the external surface of the tube is treated with a corona discharge. A plurality of bags are formed from the treated tube, and the formed bags are stacked into a pack, each formed bag having an external surface, an internal surface, a front panel, and a rear panel. The stacked bags are then subjected to pressure welding so the exterior surfaces of the bags are pressure-welded together at selected spots.

The power of the corona discharge and the force of the pressure weld are such that (i) the interior surfaces of the bags are not welded together, (ii) when a bag is pulled from the pack, the adjacent next bag in the pack is at least partly opened, and (iii) when a bag is pulled from the pack, the adjacent next bag is not torn at the selected spots. This can be effected by subjecting the tube to a corona discharge of from about 0.5 to about 5, and preferably from about 1 to about 3 watt minutes per square foot, and a pressure weld, without heat, of from about 60,000 to about 100,000 psi per square inch.

This method for making the bags is extremely efficient in that no additional steps are needed beyond what is conventionally used for making bags. A corona discharge is commonly used for preparing a surface of a bag for printing, although typically at lower wattage densities. Likewise, the pressure welding can be effected at the same time that the bags are die-cut from the tubular plastic material.

Optionally, a static charge can be induced on the bags so that each bag is at a different voltage than the adjacent bags, with the result that the bags attract each other and the panels of individual bags repel each other. This adds to the easy open feature.

The present invention is also directed to the bags prepared by this method.

DRAWINGS

These and other features, aspects, and advantages of the present invention will become better understood from the following description, appended claims, and accompanying drawings where:

FIG. 2 shows a bag pack produced by the method of flow chart of FIG. 1 mounted on a wire rack;

FIG. 3 is a side elevation view of the bag pack of FIG. 2 in the region 3 of FIG. 2;

FIG. 4 is a side elevation view of a die used in forming the bag pack of FIG. 2;

FIG. 5 is a front elevation view of the die of FIG. 4; and

DESCRIPTION

Figure 1:
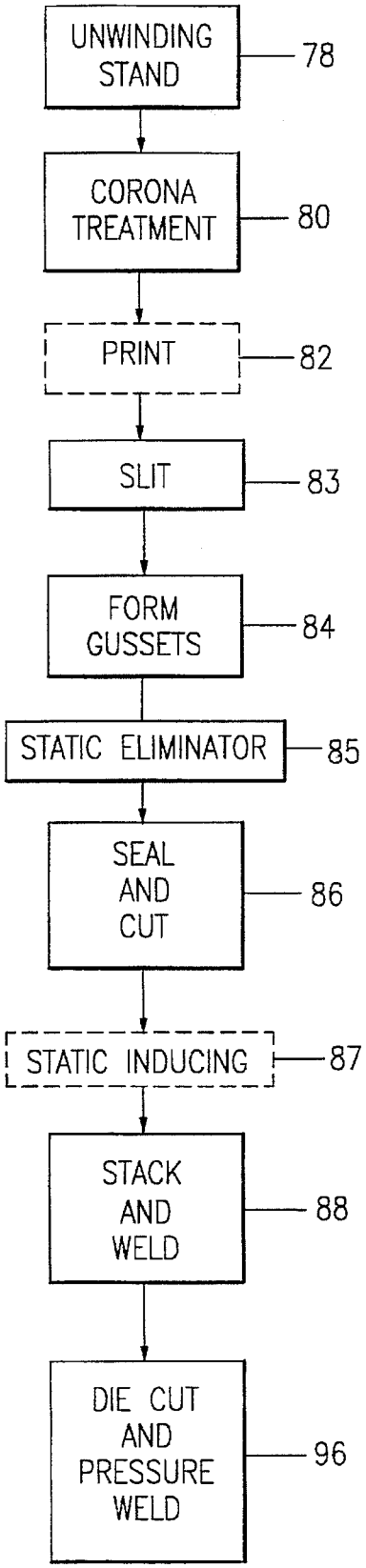
FIG. 1 is a flow chart showing the sequential steps of a method of making bags according to the present invention, where optional steps are shown by dashed lines.

Referring to FIGS. 2 and 3, a bag pack 10 comprises a plurality of multiple individual bags 12. Although such a bag pack typically contains about fifty bags 12, only a portion of the bags 12 are shown in the figures.

The bags 12 are preferably formed of a lightweight, highly flexible and strong thermoplastic material, such as low density or high density polyethylene. The bags are conventionally fabricated from a continuous plastic flattened tube that is gussetted and heat sealed at opposed upper or lower ends. The mouth 14 of the bag 12 is formed by cutout inwardly and centrally through the upper portion of the bag. The cutout can optionally define a central mounting tab (not shown) and a pair of laterally spaced, upwardly extending handles 16. The handles are formed of upwardly extending portions of the front panel 18 and rear panel 20, respectively, of the bag 12, as well as similarly upwardly extending portions of side gussets (not shown). The multiple individual bags are maintained in the pack 10 by direct heat bonding of the bags together. This bag construction is generally known in the art and described, for example, in U.S. Pat. No. 4,529,090 to Pilon.

The bags can have apertures 22 in the handles. A support rack 24 is provided for mounting the pack 10 of bags and for selectively dispensing the individual bags 12. The rack 24 has a pair of laterally spaced supporting arms 26 spaced apart a sufficient distance to accommodate a fully expanded bag with the handle 16 engaged with the supporting arms 26. The bag pack 10 is supported by and suspended from the arms 26, the arms extending through the handle apertures 22, as described, for example, in the aforementioned Baxley et al., U.S. Pat. No. Re. 33,264.

To facilitate an automatic following and opening of the bags during the loading operation, the rear panel 20 of each bag is welded in a readily disengageable manner to the forward panel 18 of the following or underlying bag. With regard to FIGS. 2 and 3 in particular, the welding can be effected at a plurality, and typically four selected locations 32 slightly spaced below the bag mouth 14. Typically these cold-welded spots 32 are rectangular in shape, and are symmetrically disposed about the longitudinal axis of each bag, i.e., with four cold welds, there are two on each side of the longitudinal axis of the bag. Because of the cold weld spots 32, when one bag is pulled off the rack, the front panel 18 of the following or underlying bag 12 is drawn forward. The top bag severs from the following bag, without any tearing of the following bag, because the cold welds 32 are readily disengageable. This leaves the following bag in an open upwardly directed position for loading.

The force of the cold weld 32 need only be sufficient to pull the extremely lightweight, flexible, front panel of the following bag from the rear panel of the following bag.

The sequential steps of a method according to the present invention for forming the bag pack 10 are presented in FIG. 1. The process differs from conventional processes in the degree of corona treatment, the optional static inducer, and the pressure welding. The process starts with an elongated, flattened tube, which has an external surface and an internal surface, mounted on an unwind stand 78. The plastic tube is subjected to a corona treatment step 80 where portions of the external surface of both sides of the tube are treated. Corona treatment has conventionally been used for preparing plastic surfaces for printing, but typically the treatment is less intense than is required by the present invention. The corona treatment is also known as electrical arc treatment, and is effected with about 0.5 to about 5, and more preferably with about 1 to about 3 watt minutes per square foot. If the corona treatment is insufficient, the cold welding is ineffective. After the corona treatment, the tube typically is slit to size in a slitting step 83.

Figure 6:
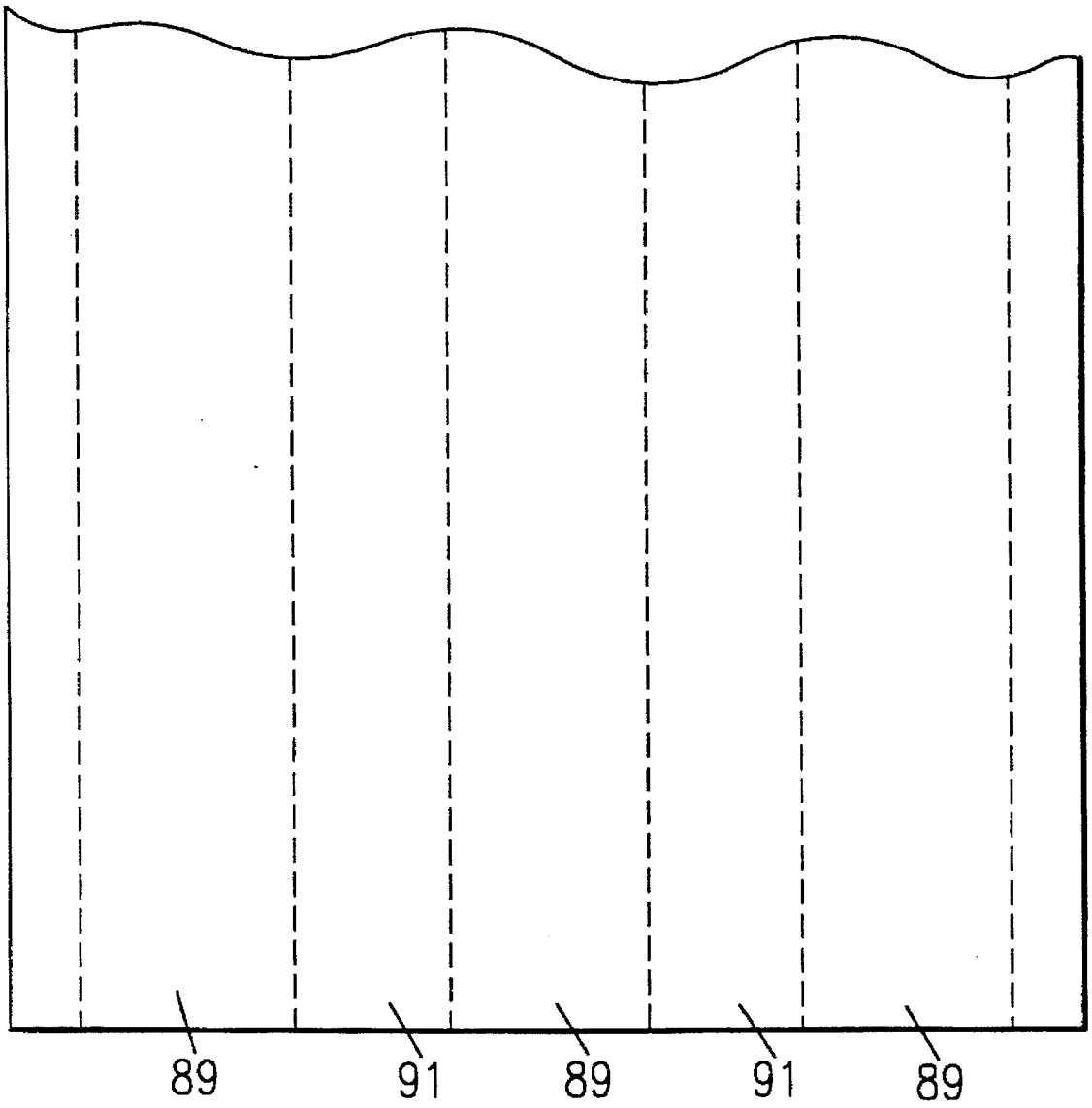
FIG. 6 is a front elevation view of a polyethylene flattened tube, the dashed lines distinguishing the corona treated and untreated segments.

In an exemplary version of the invention, the corona treatment is done with a Pillar power pack, Model No. DB4513-2 control/power supply and Model No. DB45672 transformer, available from Pillar Technologies, Ltd., located in Hartland, Wis., using a voltage in excess of about 1.5 kv, a current of 0.4 amps, and a power of 4 kw, for treating a 57-inch wide high density polyethylene flattened tube at the rate of 280 feet per minute. Only the portions of the tube that will form the outside of the front and rear panels of the bag are corona treated. For example, the 57-inch wide tube is used to form three equal sized bags by slitting the tube into three 19-inch wide segments. As shown in FIG. 6, three, equally spaced, 11-inch wide segments 89, separated by 8-inch wide untreated segments 91, are corona treated on both sides (the untreated portions form the bag sides). This treatment equals about 2.6 watt minutes per square foot, based on only the 11-inch wide segments 89 treated.

After the corona treatment, the tube is printed in a printing step 82 to provide the indicia and designs typically on a bag. This step is optional. Thus, corona treatment is used in this present invention, even when the bags are not to be printed.

The tube, after corona treatment and optionally printing, is slit in the slitting step 83 lengthwise into three equal sections, each 19 inches wide.

Next, side gussets are formed in a gusset forming step 84, and static on the tubes is removed with a static eliminator 85 which can be obtained from Tantec Inc. of Schaumburg, Ill.

After static is removed, the strips of plastic are sealed and cut to shape in step 86. Next, the slit tube is subjected to a static inducing step 87, which is optional, to create a polarity difference and a voltage differential between adjacent bags, so the bags are easy to open. Preferably the voltage difference is at least about 15,000 volts, and typically is from about 5,000 to about 25,000 volts. For example, a static inducer can be obtained from Simco of Kansas City, Mo., Model No. PN25A, which has a capacity of about 25,000 volts, and can be used for providing a voltage differential of about 30,000 volts between the front and rear panels. The static inducer operates to put a positive charge on both panels of a first bag, a negative charge on both panels of the next bag, a positive charge on the next bag, etc. The voltage difference originally induced can decrease in storage. Thus the bags attract each other so that pulling one bag from the stack tends to pull the following bags. Also, the front and rear panels of each bag repel each other so that each bag is easy to open.

The bags are then stacked in packs in step 88, and then welded together in the pack in a conventional manner, as necessary, to maintain the bags in the pack.

The pack of bags is then die-cut into the desired shape, and simultaneously, subject to pressure welding, without heat, to form the cold welded spots 32 in step 96.

Thus, the bags are rendered easy to open, without requiring any process steps beyond what is normally needed. The significant changes in the process are the increase in corona treatment and forming the pressure welds at the same time the bag is die-cut.

A die 150 suitable for die cutting is shown in FIGS. 4 and 5, and as shown in FIG. 4, the die is placed over a stack of stacked bags waiting for the die-cut and pressure welding operation 96. The die 150 used for die-cutting has an engagement tip 152 comprising a forward surface 154 and a recessed surface 156. The recessed surface 156 is typically recessed by about 1 millimeter. It has been found that if a recessed surface 156 is not provided, then when pressure welding a stack of at least 40 bags, and typically 50 bags, if sufficient pressure is put on the bags to pressure weld the bags at the bottom of the stack, excessive pressure is applied to the bags at the top of the stack causing the bags at the top of the stack to not be pressure welded together. Alternatively, without the recess, if limited pressure is used to pressure weld the rear and front panels of the top bags together, then there is insufficient pressure for pressure welding the front panel of the bottom bags in the stack to the rear panel of the adjacent bag.

In a typical embodiment of the present invention, using high density polyethylene of about 0.0005 mil thick, a die that provides a satisfactory weld has a width of 1 inch, a thickness of 0.12 inch, a recess of 1 millimeter, wherein the thickness is divided between the forward surface 154 and the recessed surface 156 (each surface is 0.06 inch wide). The pressure is from about 60,000 to about 100,000, preferably from about 70,000 to about 90,000, and typically about 80,000 psi.

Although the present invention has been described in considerable detail with reference to certain preferred versions thereof, other versions are possible. For example, rather than using corona discharge for preparing the plastic surface for cold-welding, flame treatment can be used. Therefore, the scope of the appended claims should not be limited to the description of the preferred versions contained herein.

What is claimed is:

1. A method for forming a bag pack comprising a plurality of easy open bags from a elongated, flattened tube, the tube having a external surface and an internal surface, the method comprising the steps of:

(a) treating at least a portion of the external surface of the tube with a corona discharge;

(b) forming a series of individual bags from the treated tube, wherein each individual bag of said series of bags has a front panel with respective exterior and interior surfaces and a back panel with respective exterior and interior surfaces;

(c) inducing an alternating static charge on the series of bags by inducing a first charge on said respective exterior and interior surfaces of both the front and back panels of a first individual bag and by inducing a second charge on said respective exterior and interior surfaces of both the front and back panels of a second individual bag adjacent to said first individual bag, so that at least a portion of each bag is charged, with adjacent bags being at different polarities and said front and rear panels of the individual bags are at the same polarity, thereby forming a series of alternatively charged bags;

(d) stacking the series of alternatively charged bags in a pack such that adjacent exterior surfaces of respective front and back panels of each adjacently stacked bag attract each other and the interior surfaces of respective front and back panels of each individual bag repel each other so the bags are easy to open; and (e) pressure welding the exterior surfaces of all the bags in the pack together at selected spots, wherein the power of the corona discharge and the force of the pressure weld are such that (i) the interior surfaces of each bag are not welded together, (ii) when a respective bag is pulled from the pack, an adjacent next bag in the pack is at least partly opened, and (iii) when a bag is pulled from the pack, the adjacent next bag is not torn at the selected spots.

2. The method of claim 1 wherein the bags are not printed.

3. The method of claim 1 wherein the step of treating comprises treating only a selected portion of the external surface of the tube, the selected portion being treated with about 0.5 to about 5 watt minutes per square foot.

4. The method of claim 3 wherein the step of treating comprises treating the selected portion with about 1 to about 4 watt minutes per square foot.

5. The method of claim 3 wherein the step of pressure welding comprises cold-welding the exterior surface of the bag with a force of from about 60,000 to about 100,000 pounds per square inch.

6. The method of claim 5 wherein the step of pressure welding comprises cold-welding the exterior surface of the bag with a force of from about 70,000 to about 90,000 pounds per square inch.

7. The method of claim 1 wherein the step of pressure welding comprises cold-welding the exterior surface of the bag with a force of from about 60,000 to about 100,000 pounds per square inch.

8. The method of claim 7 wherein the step of pressure welding comprises cold-welding the exterior surface of the bag with a force of from about 70,000 to about 90,000 pounds per square inch.

9. The method of claim 1 wherein each bag is symmetrical around a central longitudinal axis, and there are four selected spots, two on each side of the longitudinal axis.

10. The method of claim 1, wherein there are at least 40 bags in the bag pack, and the step of pressure welding comprises engaging the pack with an engagement tip of a die, the engagement tip having a forward surface and a recessed rearward surface so that all of the bags in the stack are pressure welded together simultaneously.

11. The method of claim 1 wherein the voltage difference between the adjacent bags is from about 5,000 to about 25,000 volts.

12. The method of claim 11 wherein the voltage difference between the adjacent bags is at least about 15,000 volts.

13. The method of claim 1 comprising the additional step of removing static from the bags before the step of inducing static on the bags.

14. A method for forming a bag pack comprising a series of easy open bags formed from an elongated, flattened tube, the method comprising the steps of:

(a) forming a series of individual bags from the tube, wherein each individual bag of the series of bags has a front panel with respective exterior and interior surfaces and a back panel with respective exterior and interior surfaces;

(b) inducing an alternating static charge on the series of bags by inducing a first charge on said respective exterior and interior surfaces of both the front and back panels of a first individual bag and by inducing a second charge on said respective exterior and interior surfaces of both the front and back panels of a second individual bag adjacent to said first individual bag, so that at least a portion of each bag is charged, with adjacent bags being at different polarities and said front and rear panels of said individual bags are at the same polarity, thereby forming a series of alternatively charged bags;

(c) stacking the series of alternatively charged bags into a pack such that adjacent exterior surfaces of respective front and back panels of each adjacently stacked bag attract each other and the interior surfaces of respective front and back panels of each individual bag repel each other so the bags are easy to open.

15. The method of claim 14 wherein charged adjacent bags have a voltage difference of from about 5,000 to about 25,000 volts.

16. The method of claim 15 wherein the voltage difference is at least about 15,000 volts.

17. The method of claim 14 comprising the additional step of removing static from the bags before the step of inducing a static charge on the bags.

18. A method for forming a bag pack comprising a plurality of easy open handle bags, the method comprising the steps of:

(a) forming an elongated, flattened tube, the tube having an external surface and an internal surface;

(b) removing static from the tube;

(c) after step (b), treating at least a portion of the external surface of the tube with a corona discharge with about 0.5 to about 5 watt minutes per square foot treated;

(d) cutting and sealing the tube to form a series of individual bags, wherein each individual bag of the series of bags has a front panel with respective exterior and interior surfaces and a back panel with respective exterior and interior surfaces;

(e) inducing an alternating static charge on the series of bags by inducing a first charge on said respective exterior and interior surfaces of both the front and back panels of a first individual bag and by inducing a second charge on said respective exterior and interior surfaces of both the front and back panels of a second individual bag adjacent to said first individual bag, so that at least a portion of each bag is charged, with adjacent bags being at different polarities and said front and rear panels of said individual bags are at the same polarity, thereby forming a series of alternatively charged bags;

(f) stacking the series of alternatively charged bags into a pack such that adjacent exterior surfaces of respective front and back panels of each adjacently stacked bag attract each other and the interior surfaces of respective from and back panels of each individual bag repel each other so the bags are easy to open;

(g) die cutting the stacked series of bags into the shape of handle bags; and (h) cold welding the exterior surfaces of the handle bags in the stack together at selected spots, with a force of from about 50,000 to 90,000 psi, wherein the power of the corona discharge and the force of the pressure weld are such that (i) the interior surfaces of the handle bags are not welded together, (ii) when a handle bag is pulled torn the pack, the adjacent next bag in the pack is at least partly opened, and (iii) when a handle bag is pulled from the stack, the adjacent next bag is not torn at the selected spots.

19. The method of claim 18 wherein the step of die cutting and pressure welding are effected simultaneously.

20. The method of claim 18 wherein the step of treating comprises treating the external surface of the tube from about 1 to about 4 watt minutes per square foot treated.

21. The method of claim 18 wherein there are at least 40 bags in the pack, and the step of pressure welding comprises engaging the pack with an engagement tip of a die, the engagement tip having a forward surface and a recessed rearward surface so that all of the bags in the stack are pressure welded together simultaneously.

22. A method for forming a bag pack comprising a plurality of easy open bags from an elongated, flattened tube, the method comprising the steps of:

(a) forming a series of individual bags from the tube, wherein each individual bag of the series of bags has a front panel with respective exterior and interior surfaces and a back panel with respective exterior and interior surfaces;

(b) removing static from the bags with a static eliminator;

(c) inducing an alternating static charge on the series of bags by inducing a first charge on said respective exterior and interior surfaces of both the front and back panels of a first individual bag and by inducing a second charge on said respective exterior and interior surfaces of both the front and back panels of a second individual bag adjacent to said first individual bag, so that at least a portion of each bag is charged, with adjacent bags being at different polarities and said from and rear panels of said individual bags are at the same polarity, thereby forming a series of alternatively charged bags;

(d) stacking the series of alternatively charged bags into a pack such that adjacent exterior surfaces of respective front and back panels of each adjacently stacked bag attract each other and the interior surfaces of respective from and back panels of each individual bag repel each other so the bags are easy to open.

23. The method of claim 22 comprising before step (b), the additional steps of:

(a) treating at least a portion of the external surface of the tube with a corona discharge; and (b) pressure welding the exterior surfaces of all the bags in the pack together at selected spots;

wherein the power of the corona discharge and the force of the pressure weld are such that (i) the interior surfaces of each of the bags are not welded together, (ii) when a bag is pulled from the pack, an adjacent next bag in the pack is at least partly opened, and (iii) when a bag is pulled from the pack, the adjacent next bag is not torn at the selected spots.

24. The method of claim 23 wherein the step of corona treating comprises treating only a selected portion of the external surface of the tube, the selected portion being treated with about 0.5 to about 5 watt minutes per square foot.

25. The method of claim 24 wherein the step of pressure welding comprises cold-welding the exterior surfaces of the bags with a force of from about 60,000 to about 100,000 pounds per square inch.

* * * * *